United States Patent [19]

Shimizu et al.

[11] Patent Number: 5,024,431

[45] Date of Patent: Jun. 18, 1991

[54] SHEET TRANSPORT DEVICE WITH EASY SHEET JAM HANDLING

[75] Inventors: Tadafumi Shimizu; Tadashi Ohira, both of Osaka, Japan

[73] Assignee: Minolta Camera Kabushiki Kaisha, Osaka, Japan

[21] Appl. No.: 257,517

[22] Filed: Oct. 13, 1988

[30] Foreign Application Priority Data

Oct. 16, 1987 [JP] Japan ..... 62-262315
Oct. 16, 1987 [JP] Japan ..... 62-262316
Oct. 16, 1987 [JP] Japan ..... 62-262317

[51] Int. Cl.[5] ..... B65H 7/12
[52] U.S. Cl. ..... 271/263; 271/274; 271/902
[58] Field of Search ..... 271/258, 259, 263, 273, 271/274, 902

[56] References Cited

U.S. PATENT DOCUMENTS

| | | | |
|---|---|---|---|
| 4,116,429 | 9/1978 | Van Buskirk | 271/274 X |
| 4,740,810 | 4/1988 | Ito | 355/56 |
| 4,743,945 | 5/1988 | Ito et al. | 355/14 SH |
| 4,750,020 | 6/1988 | Ishizu et al. | 355/14 SH |
| 4,813,658 | 3/1989 | Hosking | 271/263 X |
| 4,878,087 | 10/1989 | Sakai | 271/902 X |

*Primary Examiner*—Richard A. Schacher
*Attorney, Agent, or Firm*—Willian Brinks Olds Hofer Gilson & Lione

[57] ABSTRACT

Sheet transport device with easy sheet jam handling. The device comprises a first sheet transport path which includes a feed roller rotatable in forward and reverse directions and a pair of transport rollers separable from each other, and a second sheet transport path connected to the first path which includes an openable frame. When the frame is opened, the transport rollers are separated from each other and the feed roller is driven reversely. The device further comprises a display which indicates the position where a jammed sheet is located.

4 Claims, 9 Drawing Sheets

SHEET TRANSPORT DEVICE WITH EASY SHEET JAM HANDLING

FIELD OF THE INVENTION

The present invention relates to a sheet transport device which is employed in an image forming apparatus such as a copy machine, printer and the like, and more specifically relates to a sheet transport device having a construction which simplifies removal of jammed sheets.

BACKGROUND OF THE INVENTION

In recent years, image forming apparatus such as copy machines and printers have been endowed with various image forming capabilities, a plurality of sheet supply portions and complex paper transport paths. Thus, when a sheet jam occurs in the sheet transport path, operation efficiency is reduced in accordance with the labor of removing the jammed sheet.

For example, in the copy machine shown in FIG. 13, disposed around the image forming portion B having photosensitive drum A at its center are paper containers D and E which house paper of different sizes and supply said sheets C to the image forming portion B, and paper re-feed portion F which provides image formation to the reverse side of sheet C after image formation is completed on the obverse side when said sheet is once admitted to said image formation portion so as to make a duplex copy by forming an image on both the obverse and reverse sides of sheet C. Thereafter, sheet C, which was transported from said paper supply portion D, E and F, is fed to sheet transport path G in one vertical direction, and hence to image formation portion B through said sheet transport path G, said sheet C then being subjected to the image formation process.

Sheet transport paths H, I and J, which are disposed in the horizontal direction toward transport path G from of sheets coming from paper supply portion D, E and F, are each connected to the aforesaid vertical direction sheet transport path G at a substantially perpendicular angle, and said sheet C can readily jam at the aforesaid perpendicular junction of said paper paths.

Adoption of a construction wherein the transport paths for each transport means can be opened so as to easily remove a sheet jam, as disclosed in Japanese Examined Patent Application No. 60-223750, may be considered. However, when a jam occurs as in the situation shown in FIG. 14, the jam cannot be remedied from the other side even if the vertical sheet transport path G is opened, and although said sheet jam may be extracted from the sheet container side, such a method is difficult since the clamping feed rollers are not capable of reverse rotation and therefore provide a great deal of resistance. Thus, even if the horizontal sheet transport paths H, I and J are provided so as to be accessible by opening, the arrangement would be unsuitable relative to the vertical sheet transport path G due to the multiplicity of stages of said horizontal transport paths H, I and J. In lieu of the aforesaid configuration, extracting the sheet jam by opening the aforesaid clamping rollers may be considered.

The sheet jam removal operation becomes further complex because the operation of opening and closing the clamping transport rollers of each of the horizontal sheet transport paths H, I and J is required in addition to the operation of opening and closing the vertical sheet transport path G.

SUMMARY OF THE INVENTION

A main object of the present invention is to provide a sheet transport device with easy sheet jam handling.

Another object of the invention is to provide a sheet transport device with easy sheet jam handling accomplished by releasing the pressure of one pair of engaged sheet transport rollers when handling a sheet jam.

A further object of the invention is to provide a sheet transport device with easy sheet jam handling by having sheet transport rollers which are capable of reverse rotation when handling a sheet jam.

A still further object of the invention is to provide a sheet transport device with easy sheet jam handling by displaying the location f the sheet jam when a jam occurs.

To accomplish the aforesaid objects, the present invention comprises a first sheet transport mechanism including a first path and a pair of transport rollers for transporting a sheet along the first path, said transport rollers being pressed against each other and nipping the sheet therebetween;

a second sheet transport mechanism including a first frame member having a first roller and a second frame member having a second roller, said second frame member being movable from a first position where said first and second rollers are pressed against each other to a second position where said first and second rollers are separate from each other, said first and second frame members constituting a second path connected to said first path when said second frame member is at the first position; and an interlock mechanism for separating said pair of transport rollers from each other when said second frame member is at the second position and for pressing said pair of transport rollers against each other when said second frame member is at the first position.

Another embodiment of the present invention of a sheet transport apparatus comprises a plurality of first sheet transport mechanisms each including a first path and a pair of transport rollers for transporting a sheet along the first path, said transport rollers being pressed against each other and nipping the sheet therebetween;

a second sheet transport mechanism including a first frame member having a first roller and a second frame member having a second roller, said second frame member being movable from a first position where said first and second rollers are pressed against each other to a second position where said first and second rollers are separate from each other, said first and second frame members constituting a second path connected to each of said first paths when said second frame member is at the first position; and an interlock mechanism for separating said pairs of transport rollers from each other when said second frame member is at the second position and for pressing said pairs of transport rollers against each other when said second frame member is at said first position.

Still another embodiment of the present invention of a sheet transport apparatus comprises a sheet container for containing a plurality of sheets to be fed;

a take-up roller for taking out a sheet from the container;

a first sheet transport mechanism including a first path and a first transport roller for transporting the sheet taken out by said take-up roller along the first path;

a second sheet transport mechanism including a first frame member having a second roller and a second frame member having a third roller, said second frame member being movable from a first position where said second and third rollers are pressed against each other to a second position where said second and third rollers are separate from each other, said first and second frame members constituting a second path connected to said first path when said second frame member is at the first position.

a sheet jam detector for detecting a sheet jam;

a display for indicating the position at which the sheet jam has occurred;

a drive source for rotating said first roller in a first direction to feed the sheet toward said second path and in a second direction to return the sheet toward said container;

a detector for detecting the second frame moving from the first position to the second position and generating an opening signal;

a drive controller for controlling said drive source so that said first roller is driven in the first direction in a normal state and in the second direction in response to said opening signal when a sheet jam has occurred; and a display controller for controlling said display so that said display indicates said first path when the sheet jam has occurred in said first path and indicates said container when the jammed sheet is returned to said container.

BRIEF DESCRIPTION OF THE DRAWINGS

These and other objects and features of the present invention will become apparent from the following description taken in conjunction with the preferred embodiments thereof with reference to the accompanying drawings, in which.

PREFERRED EMBODIMENTS OF THE PRESENT INVENTION

FIGS. 1 through 10 show the first embodiment of the present invention.

Figure 1:
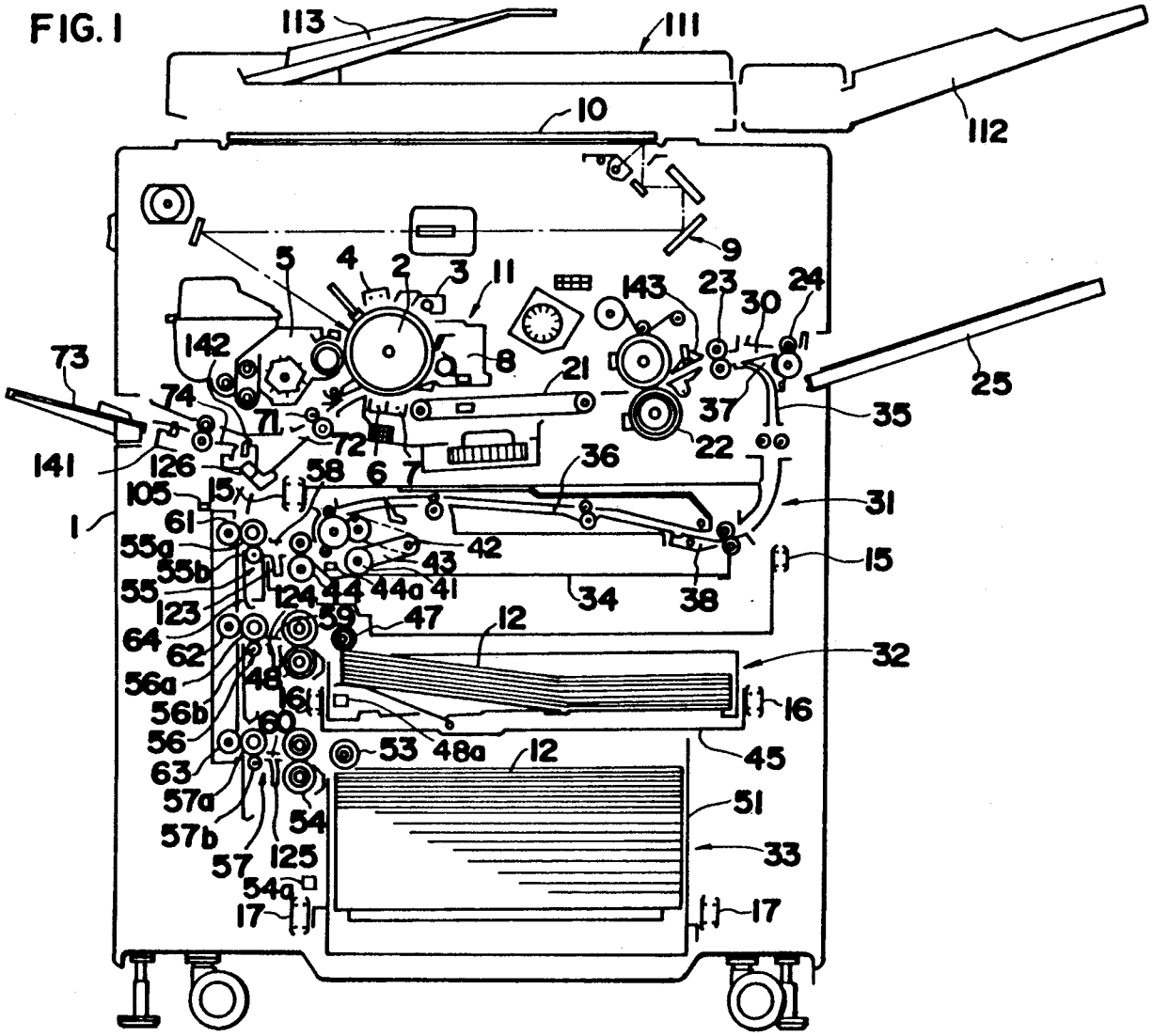
FIG. 1 is a cross section view showing the internal construction of a copy machine.

FIG. 1 shows a copy machine capable of making duplex and composite copies. The copy machine comprises, in brief, a main unit 1 and an automatic document feeder device 111 arranged thereon.

Main Unit

Main unit 1 contains an image formation portion 11 comprising a main eraser lamp 3, sensitizing charger 4, developing unit 5, transfer and separation chargers 6 and 7, cleaning unit 8 arranged around a photosensitive drum 2, and an optical system 9 for scanning the image on an original document disposed upon a document platen 10.

In sequence, photosensitive drum 2 is discharged via main eraser lamp 3, then uniformly charged by sensitizing charger 4, and subjected to an exposure of an image on an original document disposed upon document platen 10 by optical system 9. An electrostatic latent image corresponding to said original document image is thus formed on the surface of photosensitive drum 2. This electrostatic latent image is rendered visible when toner is fused thereto via developing unit 5. The visible image is then transferred to transfer sheet 12 by transfer charger 6.

After the transfer, residual toner is removed from the surface of photosensitive drum 2 by cleaning unit 8, then the residual charge thereon is discharged by main eraser lamp 3, the surface is again uniformly charged by sensitizing charger 4, and the drum is ready for the next exposure.

On the other hand, transfer sheet 12 is transported by feed belt 21 to fixing device 22 where aforesaid transferred copy image undergoes a fusing process. Thereafter, said sheet 12 is discharged by transport roller 24 to discharge tray 25 outside the main unit 1.

Below image formation portion 11 are arranged a sheet re-feed portion 31 which re-feeds to said image formation portion 11 a sheet 12 having a copy image formed on one side thereof and which is temporarily received therein so as to produce a duplex or composite copy, and top and bottom sheet feed units 32 and 33 which transport different size sheets 12 to have a copy image formed on a first side.

Sheet 12 is fed to the re-feed unit 31 through a first sheet transport path 35 which is separated from the sheet discharge path 30 by a first switching claw 37 provided medially between transport roller 23 and discharge roller 24.

Re-feed unit 31 is disposed in main unit 1 so as to be readily removable and insertable via a slide rail 15, and comprises a receiving tray 34 for receiving sheet 12, second sheet return path 36, second switching claw 38, feed roller 41, separating roller 44 and the like.

Second sheet return path 36 inverts sheet 12, which is fed toward the sheet re-feed unit 31, in an obverse-to-reverse manner and guides said sheet to tray 34. The second switching claw 38 switches so as to guide the sheet 12 being fed toward the re-feed unit 31 directly to said tray 34 (composite copy), or guide said sheet 12 to tray 34 via the second sheet return path 36 (duplex copy).

Take-up roller 41, which is provided on the sheet transport side of tray 34 is supported by arm 43 which is vertically movable upon axis 42, and is moved upward from said tray 34 when a sheet 12 is transported thereto, and presses to a suitable degree upon sheet 12 when said sheet is to be taken up from said tray 34 so as to take up said sheet from said tray 34 via the rotation of take-up roller 41.

Top sheet feed unit 32 comprises a sheet cassette 45 which is freely removable via guide rail 16 attached to main unit 1, a sheet take-up roller 47 which takes up the sheet from within said sheet cassette 45, and separating roller set 48 which separates the transported sheets one by one.

Bottom sheet feed unit 33 comprises a stocker 51 which contains a large quantity of sheets 12 and is freely removable and installable via a guide rail 17 attached to the main unit 1, take-up roller 53 which takes up said sheet from within said stocker 51, and separating roller set 54 which separates the transported sheets one by one.

Behind each of the separating roller sets 44, 48 and 54 are provided guide roller sets 55, 56 and 57 respectively; and provided medially between roller sets 44 and 55, roller sets 48 and 56, and roller sets 54 and 57 are provided in the horizontal direction first sheet transport paths 58, 59 and 60 respectively. First sheet transport paths 58, 59 and 60 each are connected in a virtual perpendicular arrangement with vertical second sheet transport path 64 which is provided with driven rollers 61, 62 and 63 which press said sheet 12 against top drive rollers 55*a*, 56*a* and 57*a*, respectively, disposed laterally thereto.

Second sheet transport path 64 transports sheet 12 taken up from sheet feed units 31, 32 and 33 upward to third sheet transport path 72 which is provided with a timing roller set 71. Third sheet transport path 72 adjusts the sheet feed timing of the transported sheet 12 via timing roller set 71, and transports said sheet 12 to the transfer portion synchronously with the arrival of the image formed upon the photosensitive drum 2.

Sheet 12, which is housed in sheet re-feed unit 31 with the obverse side having an image formed thereon disposed face up, is inverted so the obverse side is face down because second and third sheet transport paths 64 and 72 invert sheet 12 in an obverse-to-reverse manner and transport sheet 12 fed by each sheet feed unit 31, 32 and 33 to the transfer portion. Thus, the reverse side of said sheet 12 which does not yet have an image formed thereon can undergo the image formation process to produce a duplex copy. Further, the obverse side of sheet 12 which has an image formed thereon can again undergo the image formation process and thereby produce a composite copy because sheet 12, which is housed in re-feed unit 31 with the image bearing obverse side facing downward, can be inverted so that the obverse side faces upward.

Sheet transport path 74 for sheets manually fed from manual feed table 73 is connected to an intermediate position in front of the timing roller set 71 of third sheet transport path 72, thus allowing sheets to be manually fed.

Figure 2:
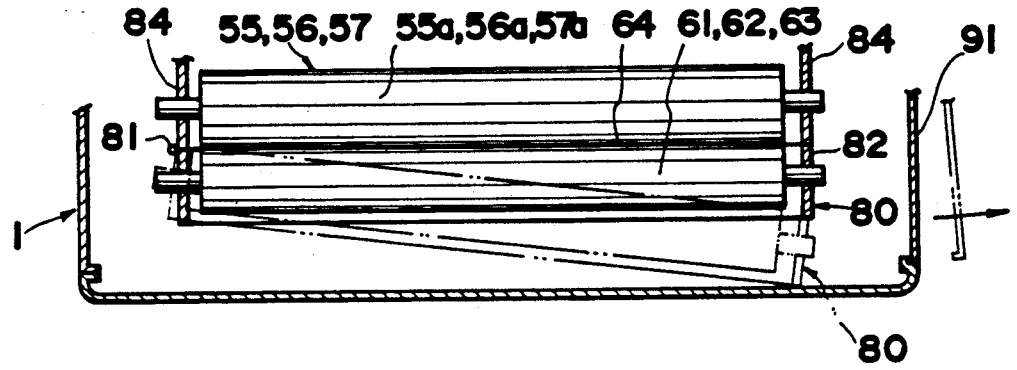
FIG. 2 is a transverse section view of the second sheet transport path.
Figure 3:
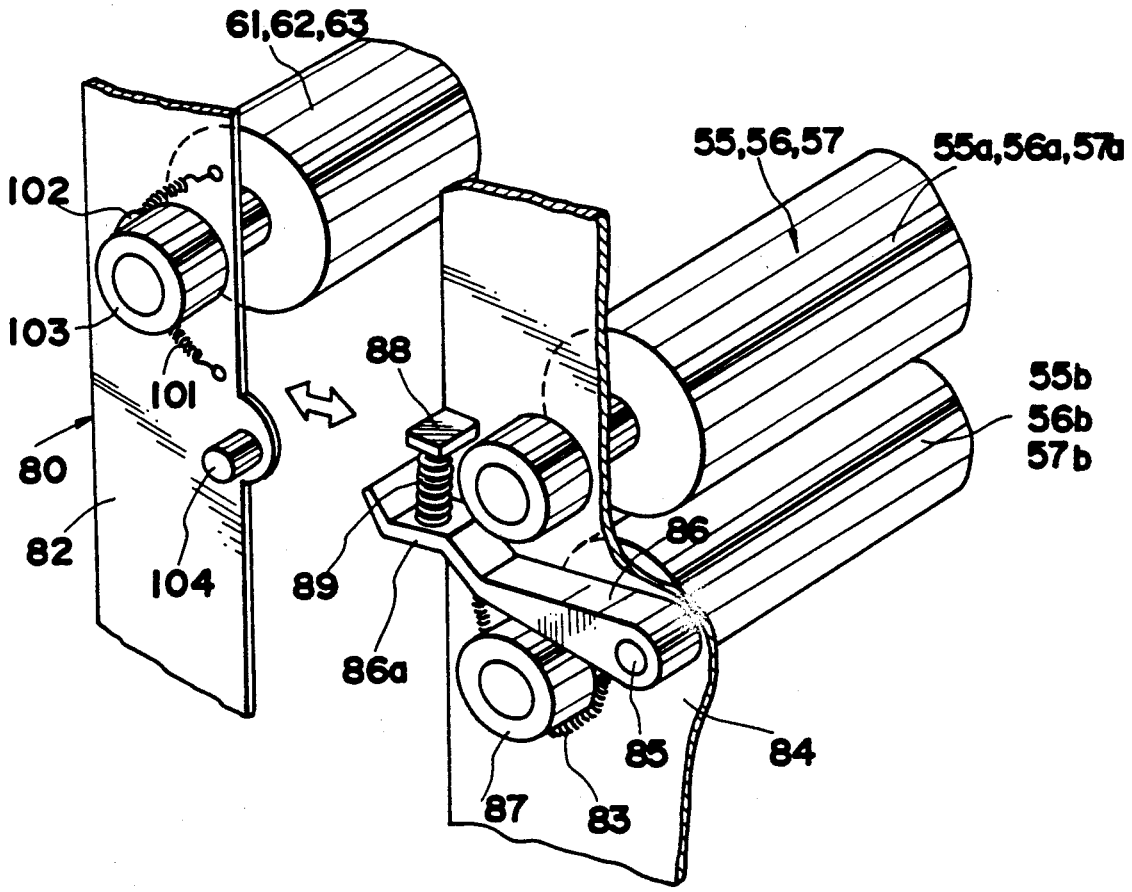
FIG. 3 is a perspective view of one side of the transport path unit in the open state.

The driven rollers 61, 62 and 63 of second sheet transport path 64 are, respectively, mounted to frame 82 which is connected by hinge 81 to interior side panel 84 of main unit 1 which is provided with first sheet transport paths 58, 59 and 60, thereby forming transport path unit 80 which is accessible by opening on one side, as shown in FIGS. 2 and 3. This transport path unit 80 is rotatable about hinge 81, thus allowing second transport path 64 to be opened and closed, as described by the solid and imaginary lines shown in FIG. 2, and thereby disengaging the respective transport means rollers 55*a* and 61, 56*a* and 62, and 57*a* and 63.

Therefore, when a sheet 12 jams in said second sheet transport path 64, the jam condition can be examined or the jammed sheet 12 can be removed by opening said sheet transport path 64. To this end, the side panel 91 of main unit 1 can be opened.

Figure 4:
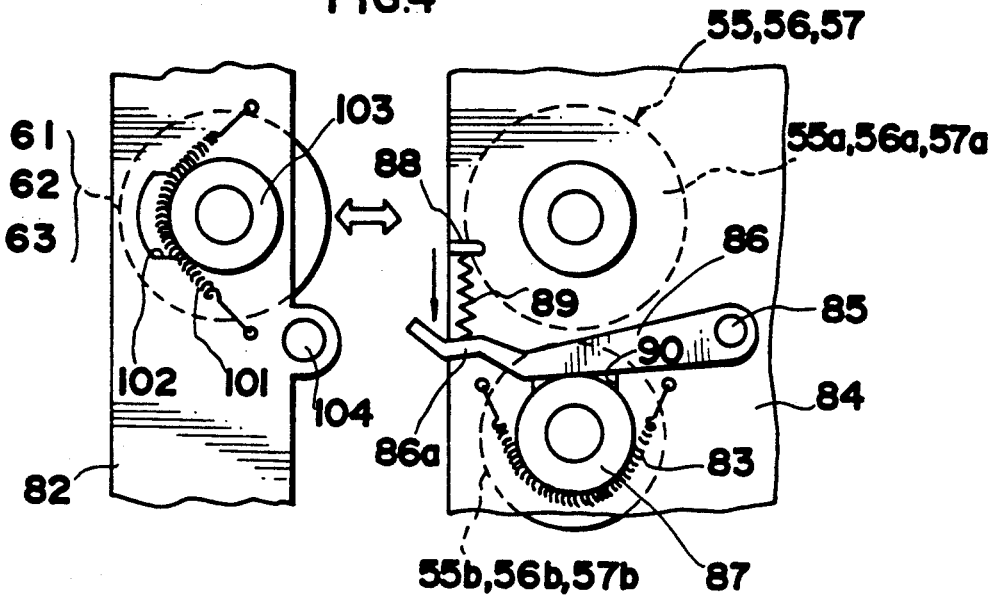
FIG. 4 is a side elevation view of one side of the transport path unit in the open state.
Figure 5:
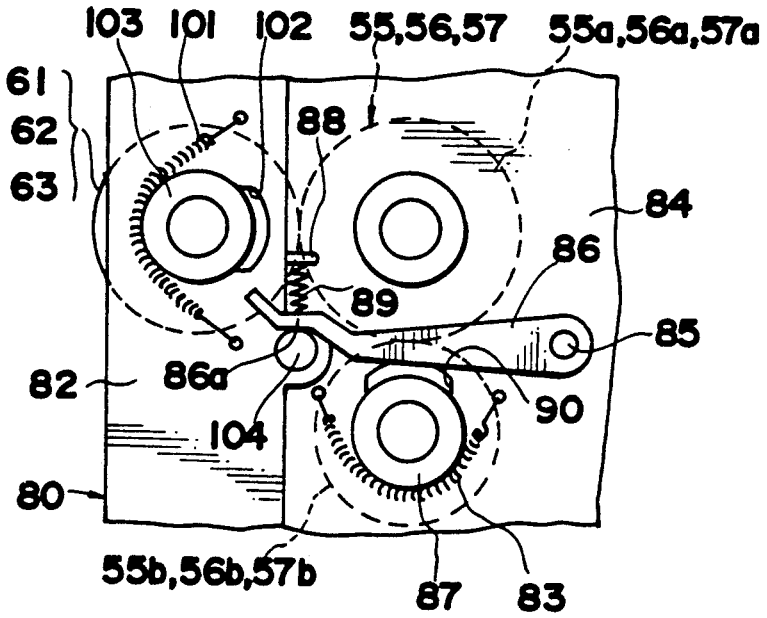
FIG. 5 is a side elevation view of one side of the transport path unit in the closed state.

The bottom rollers 55*b*, 56*b* and 57*b* of transport roller sets 55, 56 and 57 are driven rollers which press against top drive rollers 55*a*, 56*a* and 57*a*. Bottom driven rollers 55*b*, 56*b* and 57*b* are supported by bearing 87 which is movable via slot 90 of side panel 84, i.e., said bearing 87 is held by spring 83 which is stationary at both ends and which applies a suitable pressure thereto, as shown in FIGS. 3 through 5.

Side panel 84 is constructed so as to release the pressure state of bottom driven rollers 55*b*, 56*b* and 57*b* when the transport path unit 80 is open. More concretely, said construction comprises axle 85 mounted to side panel 84, lever 86 supported at one end by said axle 85, spring clip plate 88 fixedly attached to side panel 84, and spring 89 which is provided medially to spring clip plate 88 and the other end of lever 86 and which acts to change the position of lever 86 in a downward direction. Spring 89 is capable of considerably more spring tension than spring 83. Accordingly, when the transport path unit 80 is open, lever 86 presses bottom driven rollers 55*b*, 56*b* and 57*b* in a downward direction via action of spring 89, as shown in FIG. 4.

On the other hand, a push pin 104 is fixedly attached to frame 82 of transport path unit 80 to stop the operation of the aforesaid release mechanism. When transport path unit 80 is closed, as shown in FIG. 5, push pin 104 slips beneath the curved tip 86*a* of lever 86 and pushes said lever upward so that said lever 86 is pushed upward against the resistance of spring 89. Thus, the downward tension of bottom driven rollers 55*b*, 56*b* and 57*b* is released, and said bottom rollers press against top rollers 55*a*, 56*a* and 57*a* due to the tension of spring 83.

The driven rollers 61, 62 and 63 of transport path unit 80 are arranged so as to press against top drive rollers 55*a*, 56*a* amd 57*a* when transport path unit 80 is closed. Driven rollers 61, 62 and 63 are supported by bearing 103 which is movable in slot 102 of side panel 82, i.e., said bearing 103 is held by spring 101 which is stationary at both ends and which applies a suitable pressure thereto, as shown in FIGS. 3 through 5.

According to the aforesaid construction, when transport path unit 80 is opened to repair a sheet jam or the like, the second sheet transport path 64 opens releasing the transport means, i.e. transport rollers 61 and 55*a*, 62 and 56*a*, and 63 and 57*a*, and the transport roller sets 55, 56 and 57 of first sheet transport paths 58, 59 and 60 are released from the pressure state. Thus, a sheet 12 which reaches the second sheet transport path 64 before jamming can be smoothly extracted from transport roller sets 55, 56 and 57 of the first sheet transport path 64 without any resistance whatsoever from said roller sets. Further, if transport path unit 80 is closed, each of the sheet transport paths 58, 59, 60 and 64 return to normal transport operating condition.

A sensor 105 is provided to detect the opening and closing of transport path unit 80 (refer to FIG. 1). When sensor 105 detects that transport path 80 is open for maintenance of a sheet jam, separating roller sets 44, 48 and 54 are actuated by motors 44*a*, 48*a* and 54*a* which can rotate in the forward and reverse directions to rotate reversely. The jammed sheet on the side of feed units 31, 32 and 33 is returned to said feed units 31, 32 and 33 from said separating roller sets 44, 48 and 54.

Then, the return of said sheet to the feed unit and the operating conditions can be visually verified from the open second sheet transport path.

When a sheet 12 is jammed at transport roller set 55, 56 or 57, or transport roller 61 and 55*a*, 62 and 56*a*, or 63 and 57*a* and said roller sets are opened, said jammed sheet 12 is smoothly returned to feed units 31, 32 and 33 automatically and without hindrance. The returned sheet can be removed from the main unit 1 without being returned atop a normal sheet in feed unit 31, 32 or 33. If it is desired that said jammed sheet be returned atop a normal sheet so as to be reused, reverse rotation of feed rollers 41, 47 and 53 together with separating roller sets 44, 48 and 54 is desirable. When jammed sheet 12 is removed from transport roller sets 55, 56 and 57, or automatically returned to feed units 31, 32 and 33 without hindrance, said rollers may also be allowed to rotate freely in lieu of the aforesaid pressure release operation. In short, said rollers may be allowed free rotation vis-a-vis sheet 12.

Figure 7:
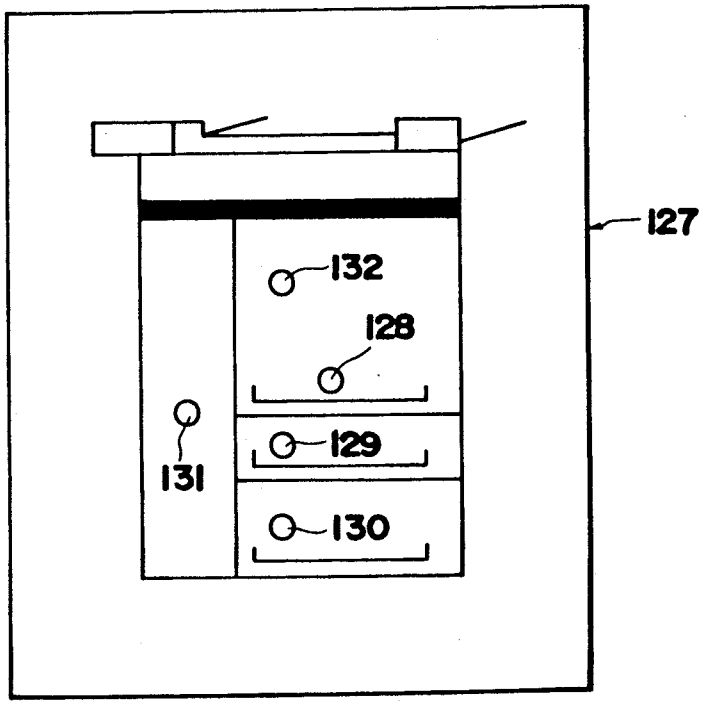
FIG. 7 is a top view of the jam display portion.

To simplify the sheet jam handling process, a jam display 127 is provided, as shown in FIG. 7, on the operation panel not shown in the drawing of main unit 1. Jam display 127 is provided with jam position display LEDs 128 through 132 which correspond to the locations of jams in the brief drawing of main unit 1. These LEDs indicate a sheet jam when they are lighted, and indicate the location of said jam via the position of the lighted LED. For example, LEDs 128 through 130 indicate a jam at feed units 31, 32 and 33 respectively, while LED 131 indicates a jam at each sheet transport path 58, 59, 60 and 64, and LED 132 indicates a jam in the vicinity of image formation portion 8 and at fixing device 22.

When a jam occurs in the aforesaid sheet transport paths 58, 59, 60 and 64 and said jammed sheet 12 is automatically returned to feed units 31, 32 or 33, one of the jam location display LEDs 128, 129 or 130 is switched ON corresponding to feed unit 31, 32 or 33 to which said jammed sheet was automatically returned after the jam position display 131 is switched ON at the moment said sheet 12 return is complete. When sheet 12 is returned, therefore, the particular feed unit, i.e. feed unit 31, 32 or 33, at which said sheet can be found is indicated.

Automatic Document Feeder

The top of main unit 1 is provided with an automatic document feeder 111. A plurality of original documents are disposed on top of document table 112, they are automatically transported to document platen 10 in sequence and copied, then sequentially discharged to document discharge tray 113. Thus, the control system for both the main unit 1 and automatic document feeder 111 of the copy machine can receive and deliver a variety of signals.

Control Circuit

Figure 8:
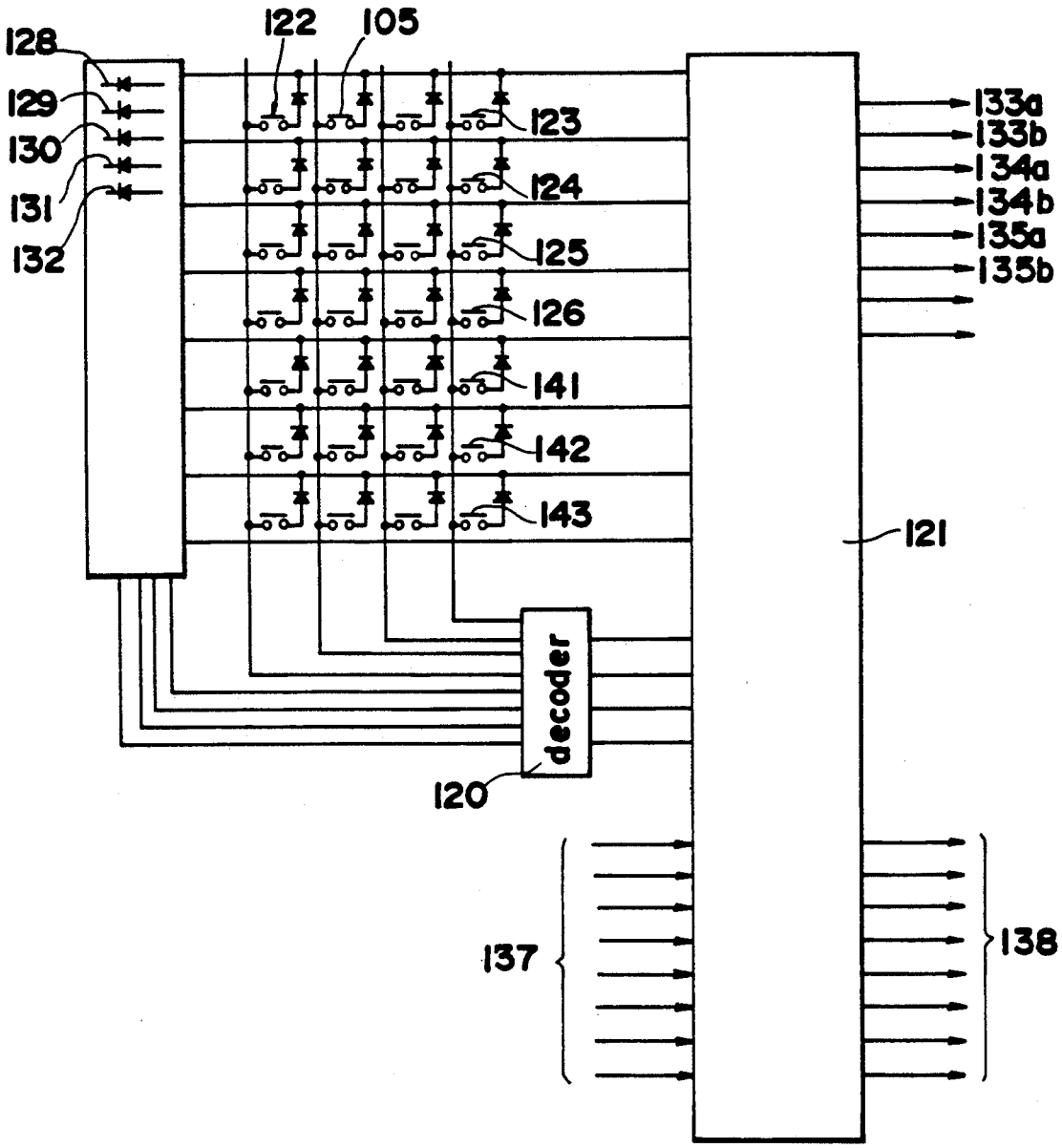
FIG. 8 is a block diagram of the copy machine control circuit.

The following description pertains only to the control means of the main unit 1 of the copy machine in the interest of simplicity. However, the description focuses on points related to the present invention. The microcomputer shown in FIG. 8 is used as the control means.

Microcomputer 121 comprises a matrix having a decoder 120. Microcomputer 121 receives inputs from various input switch groups 122 and sensor 105 which detects when transport path unit 80 is open, and sheet detection switches 123 to 126, and 141 to 143 which detect jams in each sheet feed path. Microcomputer 121 also controls the various displays of jam position indicator LEDs 128 through 132 in jam display portion 127, shown in FIG. 7. Microcomputer 121 also actuates rotation in the normal direction of each guide roller set 44, 48 and 54 on first sheet transport paths 58, 59 and 60 from sheet re-feed unit 31, top feed unit 32 and bottom feed unit 33, and is also connected to reverse rotation output leads 133*a* to 135*a* and 133*b* to 135*b*. Items 137 and 138 are other input and output leads connected to microcomputer 121.

Control Sequence

The control sequences focusing on sheet jam handling is described hereinafter with reference to the flow charts shown in FIGS. 9 and 10.

Figure 9:
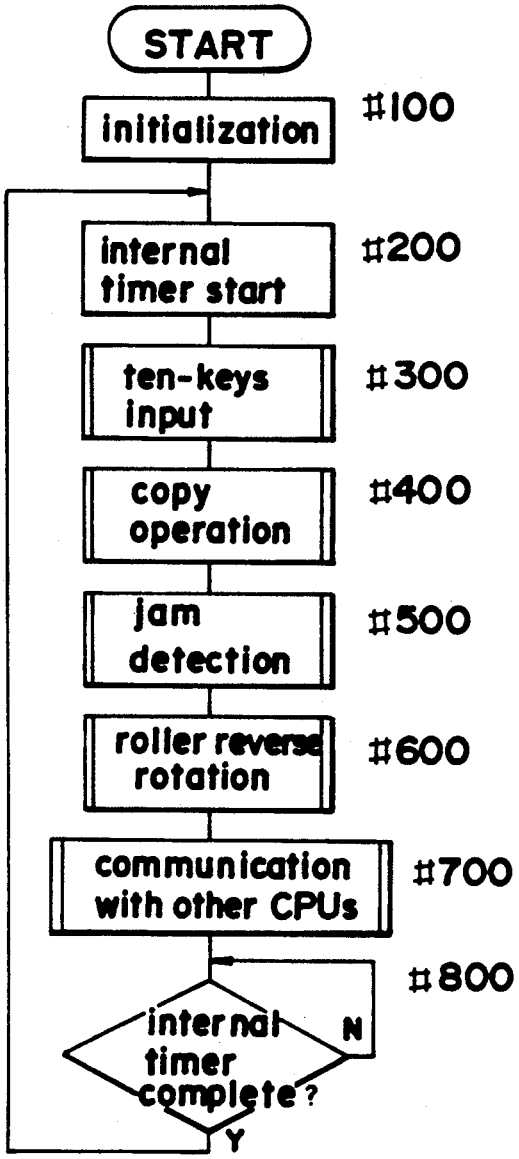
FIGS. 9 and 10 are flow charts showing the control sequence.

FIG. 9 shows a brief flow chart illustrating the main routine of microcomputer 121.

When microcomputer 121 is reset and the program is started, the random access memory (RAM) in the microcomputer is cleared and the initialization settings are set to initialize the setting of various registers and set the device initialization mode (step 100). Then, in step 200, the internal timers are set at predetermined settings. As shown in the flow chart, each subroutine 300, 400, 500, 600 and 700 is called in sequence, and when each subroutine is completed, the completion of the internal timer set initially is awaited (step 800), whereupon routine 1 is completed. Each timer appearing within a subroutine counts using the time of routine 1. (The completion of the timers is determined based on the number of times routine 1 is initiated.)

Figure 10:
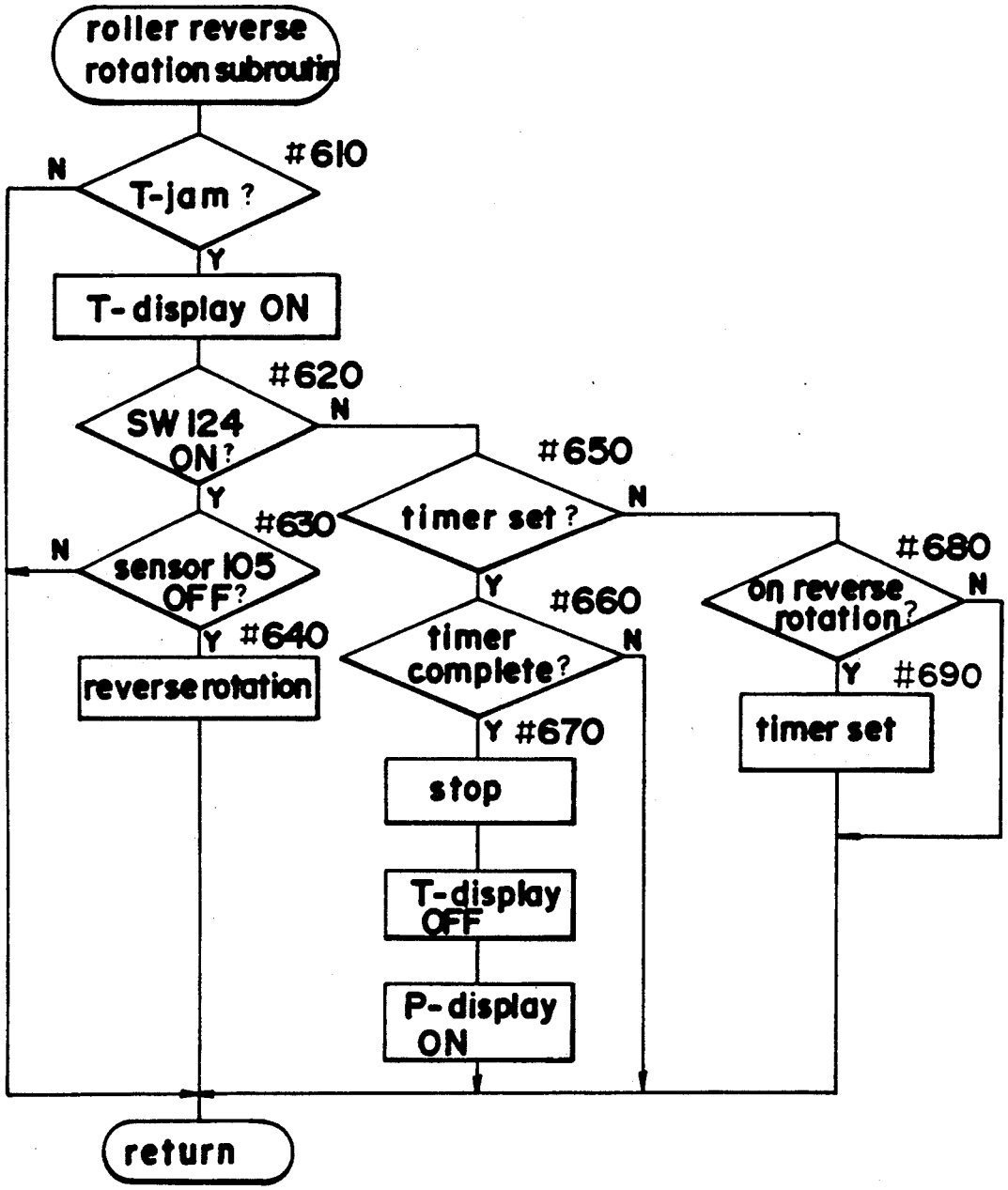

FIG. 10 is a brief flow chart showing the subroutine for the roller reverse rotation process in step 600 of the main routine shown in FIG. 9.

In the jam detection subroutine of step 500 in the main routine shown in FIG. 9, detection of various sheet jams and common processing during a jam is performed. The details of this subroutine as well as subroutines 100–400 and 700 are not a part of the present invention and are not described in detail herein. After one of the sheet detection switches 123, 124 or 125 in first sheet transport paths 58, 59 and 60 switches ON and sheet feed has been confirmed, the occurrence of a jam and said jam location are determined when sheet detection switch 126 does not detect said sheet for over a defined time period, then the process required to stop the sheet transport operation is performed.

The roller reverse rotation process is activated only when a jam in the transport section is confirmed in step 610, jam location display LED 131 switches ON, and a determination is made as to whether one of the sheet detection switches 123, 124 or 125 is in the switched ON state (step 620).

A description of the aforesaid jam process with regard to sheet feed from the top feed unit 32 follows hereinafter.

With the sheet detection switch 124 in the ON state, the condition of transport path unit 80 is examined (step 630). When sensor 105, which detects if transport path unit 80 is open, is ON, it is determined that transport path unit 80 is closed, and the routine terminates. When sensor 105 is OFF, i.e. when it is determined that transport path unit 80 is open, separating roller reverse rotation is initiated (step 640). When the transport path unit 80 is open, pressure is released from transport rollers 61 and 55*a*, 62 and 56*a*, and 63 and 57*a*, as well as transport roller sets 55, 56 and 57. Jammed sheet 12 is then returned without hindrance to top feed unit 32 via the reverse rotation of guide roller 48. Thereafter, the program continues to step 650 when the sheet detection switch 124 switches OFF and sheet 12 returns, and the status of separating guide roller set reverse rotation timer is checked. Because the timer is not initially set, the program continues to step 680 and the timer is set in step 690. The timer may count in excess of the timer required for the guide roller set 48 to release after sheet detection switch is switched OFF. When the timer is set, the next cycle continues from step 650 to step 660 where a check is made to determine whether or not the timer has completed. If the timer has completed, the routine continues to step 670 and the separating roller set 48 reverse rotation is terminated, transport path unit 80 jam position display LED 131 is switched OFF, top feed unit jam position display LED 129 is switched ON, and the process is completed.

The aforesaid jam handling process described above is identical to processes for the other feed units 31 and 33.

Figure 11:
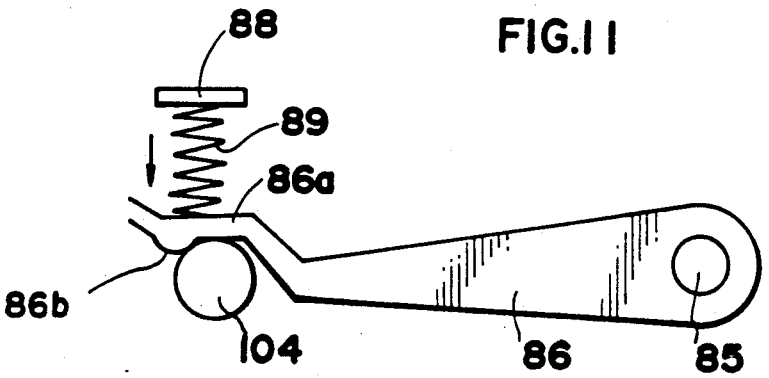
FIG. 11 is a side elevation view showing an example of lever modification.
Figure 6:
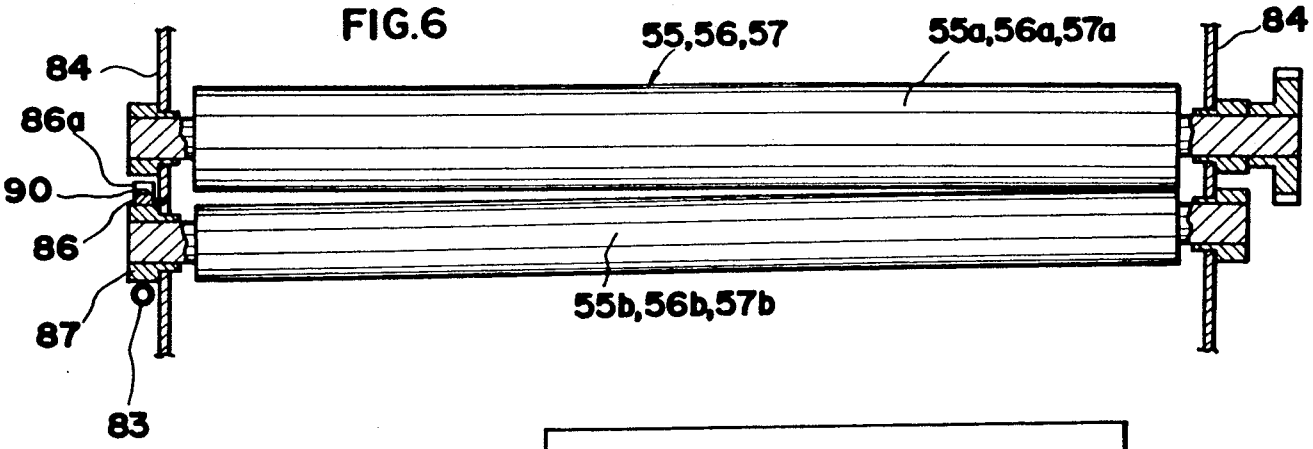
FIG. 6 is a vertical section view of the first sheet transport path.

FIG. 11 shows a modified example of the aforesaid embodiment comprising a push pin 104 at the underside of the curved tip 86*a* of lever 86 and a connecting portion 86*b* thereof to release the pressure of driven rollers 55*b*, 56*b* and 57*b*. When transport path unit 80 is closed, the push pin is elastically connected to said connector 86*b*, and the driven rollers 61 62 and 63 press against drive rollers 55*a*, 56*a* and 57*a* via the action of spring 101 so as to elastically stop transport path unit 80 in the closed position.

A separate locking means is therefore unnecessary to maintain said transport path unit 80 in the closed state.

Figure 12:
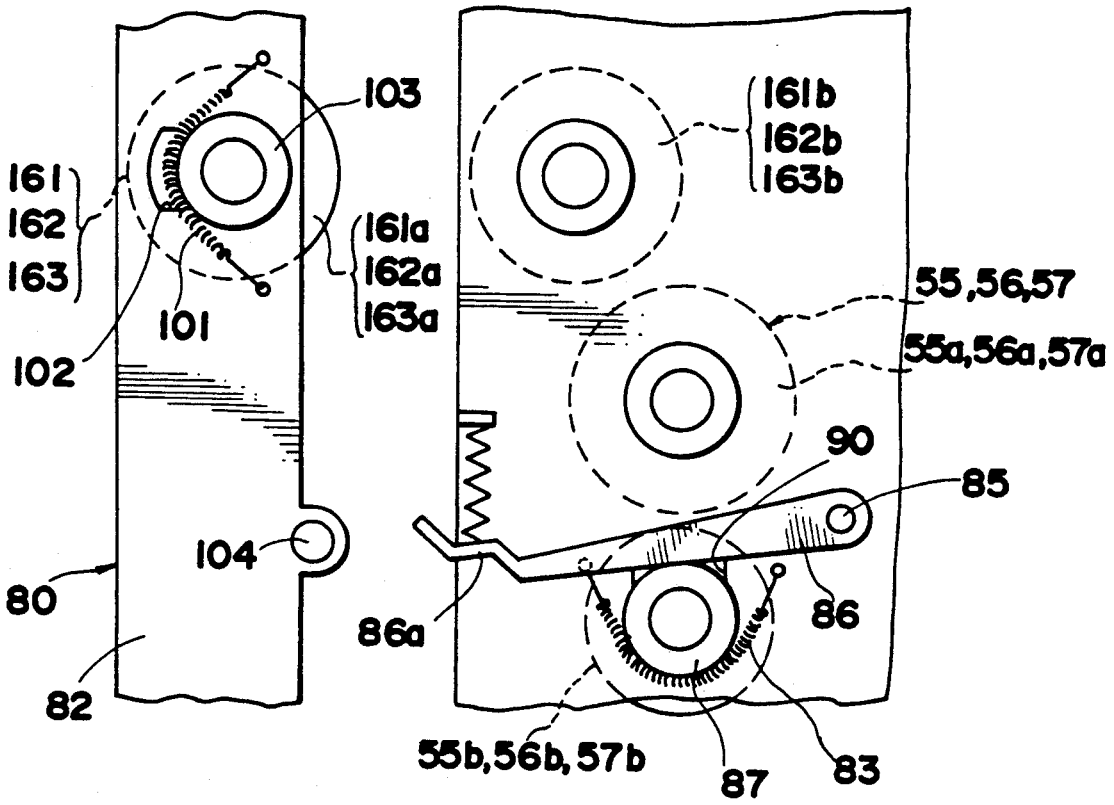
FIG. 12 is a side elevation showing another version of the second transport path.
Figure 13:
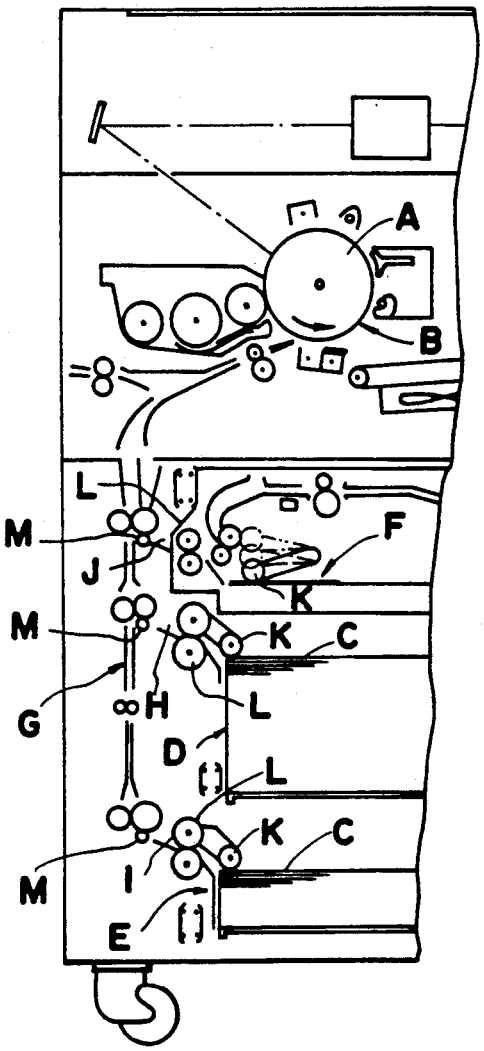
FIG.13 PRIOR ART
FIGS. 13 and 14 are illustrations to explain the concept of the present invention.
Figure 14:
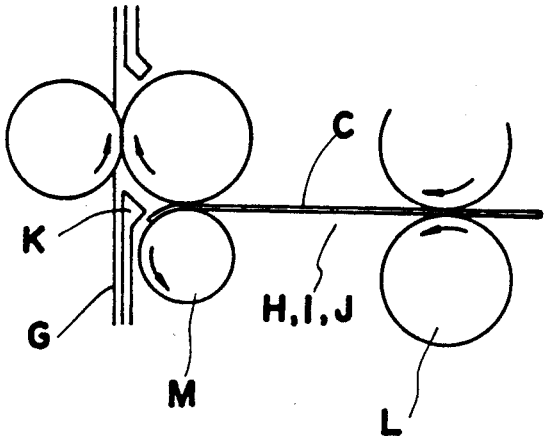
FIG.14 PRIOR ART

A portion of horizontal sheet transport path 58, 59 and 60 acts with the vertical sheet transport path transport roller sets 55, 56 and 57 only so as to open and close in connection with the opening and closing of the vertical sheet transport path 64. However, as shown in FIG. 12, each transport roller set 55, 56 and 57, provided in the vicinity of the connection between horizontal transport paths 58, 59 and 60 and vertical sheet transport path 64, can be formed of roller pairs 55*a* and 55*b*, 56*a* and 56*b*, and 57*a* and 57*b*; and transport roller sets 161, 162 and 163 may be formed of mutually independent rollers 161*a* and 161*b*, 162*a* and 162*b* and 163*a* and 163*b*. Accordingly, the other transport means in the aforesaid embodiment, i.e. separating guide roller sets 44, 48 and 54, do not open, and may be endowed to allow free rotation so as to free the transported sheet. A free rotation transport means does not require reverse rotation control to release the jammed sheet.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet transport apparatus comprising:

a first sheet transport mechanism including a first path and a first roller for transporting a sheet along the first path;

a second sheet transport mechanism including a first frame member having a second roller and a second frame member having a third roller, said second frame member being movable from a first position where said second and third rollers are pressing against each other to a second position where said second and third rollers are separate from each other, said first and second frame members constituting a second path connected to said first path when said second frame member is at the first position;

a drive source for rotating said first roller in a first direction to feed the sheet toward said second path and in a second direction reverse to said first direction;

a detector for detecting the second frame moving from the first position to the second position and for generating an opening signal; and a controller for controlling said drive source so that said first roller is driven in the first direction in a normal state and in the second direction in response to said opening signal.

2. The sheet transport apparatus as claimed in claim 1, further comprising a sheet detector for detecting the sheet in the second path and generating a sheet signal, wherein said drive source is driven when both said opening signal and said sheet signal are generated.

3. The sheet transport apparatus as claimed in claim 1, further comprising a sheet container for containing the sheets to be fed through said first path, wherein said drive source drives said first roller in the second direction until the sheet in the first path is transported to the container.

4. A sheet transport apparatus comprising:

a sheet container for containing a plurality of sheets to be fed;

a take-up roller for taking out a sheet from the container;

a first sheet transport mechanism including a first path and a first roller for transporting the sheet taken out by said take-up roller along the first path;

a second sheet transport mechanism including a first frame member having a second roller and a second frame member having a third roller, said second frame member being movable from a first position where said second and third rollers are pressed against each other to a second position where said second and third rollers are separate from each other, said first and second frame members constituting a second path connected to said first path when said second frame member is at the first position;

a sheet jam detector for detecting a sheet jam;

a display for indicating the position at which the sheet jam has occurred;

a drive source for rotating said first roller in a first direction to feed the sheet toward said second path and in a second direction to return the sheet toward said container;

a detector for detecting the second frame moving from the first position to the second position and for generating an opening signal;

a drive controller for controlling said drive source so that said first roller is driven in the first direction in a normal state and in the second direction in response to said opening signal when a sheet jam has occurred; and a display controller for controlling said display so that said display indicates said first path when the sheet jam has occurred in said first path and indicates said container when the jammed sheet is returned to said container.

* * * * *